US007918003B2

(12) United States Patent
Acciardo, Jr.

(10) Patent No.: US 7,918,003 B2
(45) Date of Patent: Apr. 5, 2011

(54) KINGPIN BUSHING INSTALLATION TOOL

(76) Inventor: Andrew T. Acciardo, Jr., West Columbia, SC (US)

( * ) Notice: Subject to any disclaimer, the term of this patent is extended or adjusted under 35 U.S.C. 154(b) by 390 days.

(21) Appl. No.: 12/289,612

(22) Filed: Oct. 30, 2008

(65) Prior Publication Data

US 2009/0106963 A1 Apr. 30, 2009

Related U.S. Application Data

(60) Provisional application No. 61/001,154, filed on Oct. 31, 2007.

(51) Int. Cl.
*B25B 27/14* (2006.01)

(52) U.S. Cl. ..... 29/263; 29/265; 29/270; 29/278

(58) Field of Classification Search ..... 29/263, 29/244–262, 265–280
See application file for complete search history.

(56) References Cited

U.S. PATENT DOCUMENTS

| | | | | |
|---|---|---|---|---|
| 1,357,146 | A | 10/1920 | Case | |
| 1,400,676 | A | 12/1921 | Gully | |
| 1,483,670 | A | 7/1922 | McKee et al. | |
| 1,530,866 | A | 1/1924 | Wakefield | |
| 1,587,916 | A | 3/1925 | Malone | |
| 1,641,269 | A | 9/1927 | Hoke | |
| 1,863,956 | A | 6/1931 | Wilson | |
| 2,497,498 | A | 4/1948 | Hamilton | |
| 2,619,717 | A * | 12/1952 | Gober | 29/265 |
| 2,861,330 | A | 12/1956 | Kratz | |
| 3,209,445 | A | 1/1962 | Moskovitz | |
| 4,339,865 | A | 7/1982 | Shultz | |
| 4,586,228 | A | 5/1986 | Rodolf | |
| 4,635,952 | A | 1/1987 | Smith | |
| 5,177,853 | A * | 1/1993 | Herook | 29/266 |
| 5,528,809 | A | 6/1996 | Green et al. | |
| 5,623,761 | A * | 4/1997 | Chiang | 29/724 |
| 6,029,331 | A * | 2/2000 | Simmons | 29/239 |
| 6,415,492 | B1 | 7/2002 | Jamison | |
| 6,442,817 | B1 | 9/2002 | Swanson | |
| 6,886,228 | B1 * | 5/2005 | Chen | 29/263 |
| 6,886,230 | B2 | 5/2005 | Dagot | |
| 7,096,551 | B2 | 8/2006 | Lackowski, II | |
| 7,191,504 | B1 | 3/2007 | Charron | |
| 7,707,709 | B2 * | 5/2010 | Whitehead | 29/724 |
| 7,845,057 | B2 * | 12/2010 | Hsiao | 29/255 |
| 2009/0106963 | A1 * | 4/2009 | Acciardo, Jr. | 29/270 |
| 2009/0199382 | A1 * | 8/2009 | Heaton | 29/270 |

* cited by examiner

*Primary Examiner* — Lee D Wilson
(74) *Attorney, Agent, or Firm* — Richard C. Litman

(57) ABSTRACT

The kingpin bushing installation tool is a dual-headed insertion tool for installing kingpin bushings within the cylinder cavities of a steering knuckle. The kingpin bushing installation tool includes a rod having opposed upper and lower ends. An upper bushing-engaging member is mounted on the upper end of the rod and includes an upper portion, an intermediate portion and a lower portion. The intermediate portion has a diameter greater than a diameter of the lower portion, and the upper portion has a diameter greater than the diameter of the intermediate portion. A lower bushing-engaging member is adjustably and removably mounted on the lower end of the rod and includes an upper portion, an intermediate portion and a lower portion. The intermediate portion thereof has a diameter greater than a diameter of the upper portion, and the lower portion has a diameter greater than the diameter of the intermediate portion.

17 Claims, 12 Drawing Sheets

KINGPIN BUSHING INSTALLATION TOOL

CROSS-REFERENCE TO RELATED APPLICATION

This application claims the benefit of U.S. Provisional Patent Application Ser. No. 61/001,154, filed Oct. 31, 2007.

BACKGROUND OF THE INVENTION

1. Field of the Invention

The present invention relates to bushing installation tools, and more particularly to a kingpin bushing installation tool for installation of kingpin bushings in truck steering systems.

2. Description of the Related Art

A mechanical bushing is a cylindrical lining that is designed to reduce friction and wear inside a cavity, or constrict and restrain motion of mechanical parts. A kingpin bushing is generally a solid metallic ring, commonly made from babbitt or copper. Kingpin bushings are typically hand-hammered or machine press fitted into an annular cavity that has been removed from a wheel assembly, such as that of a truck steering knuckle.

Truck steering knuckles generally are housed within a cylindrical cavity of a drum or some other type of housing structure. The cylindrical bore of the steering knuckle cavity defines the cylindrical structure passage for the kingpin bushing. The inner diameter of a kingpin bushing is narrowly tailored to closely match the inner diameter of the steering knuckle cylinder after installation. One or more kingpin bushing cylindrical cavities provide a rotational, bearing-type support and maintain the steering mechanism in vertical alignment. The kingpin bushings prevent the steering mechanism from wobbling and wearing against the cylinder walls.

Kingpin bushings are typically installed via one of two primary methods: First, a bushing may be placed on the end of a solid steel cylinder installer and then the cylinder is pounded with a hammer or mallet to press fit the kingpin bushing into the steering knuckle cavity. Alternatively, the steering knuckle is commonly extracted away from the front-end steering assembly and the kingpin bushings are inserted by machine press fit.

In the first method, the steel installer typically does not properly vertically align within the cavity wall, thus causing damage to the kingpin bushing. Such damage during installation can cause the kingpin bushing to deform during use. Such misalignment can also occur via the second common method noted above.

Further, neither method allows for installation of a pair of bushings, such as the upper and lower bushings commonly needed within the vertical steering knuckle of a truck. Such installers are, further, typically only sized and contoured for a particular type of bushing, and may not be used on a variety of vehicles.

Thus, a kingpin bushing installation tool solving the aforementioned problems is desired.

SUMMARY OF THE INVENTION

The kingpin bushing installation tool is a dual-headed insertion tool for installing kingpin bushings within the cylinder cavities of a steering knuckle. The kingpin bushing installation tool includes a rod having opposed upper and lower ends, which is preferably threaded. An upper bushing-engaging member is mounted on the upper end of the rod. The upper bushing-engaging member includes an upper portion, an intermediate portion and a lower portion. The intermediate portion has a diameter greater than a diameter of the lower portion, and the upper portion has a diameter greater than the diameter of the intermediate portion.

A lower bushing-engaging member is adjustably and removably mounted on the lower end of the rod. The lower bushing-engaging member also includes an upper portion, an intermediate portion and a lower portion. The intermediate portion thereof has a diameter greater than a diameter of the upper portion, and the lower portion thereof has a diameter greater than the diameter of the intermediate portion. The lower bushing-engaging member is adjustably and releasably secured to the lower end of the rod by a torque nut or the like.

In an alternative embodiment, the upper bushing-engaging member also includes an upper portion, an intermediate portion and a lower portion, with the intermediate portion including a plurality of segments. The central segment has a diameter greater than the diameters of the upper and lower portions. The lower bushing-engaging member is adjustably and removably mounted on the lower end of the rod, with the lower bushing-engaging member having an upper portion, an intermediate portion and a lower portion. The intermediate portion thereof has a diameter greater than a diameter of the upper portion, and the lower portion thereof has a diameter greater than the diameter of the intermediate portion.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
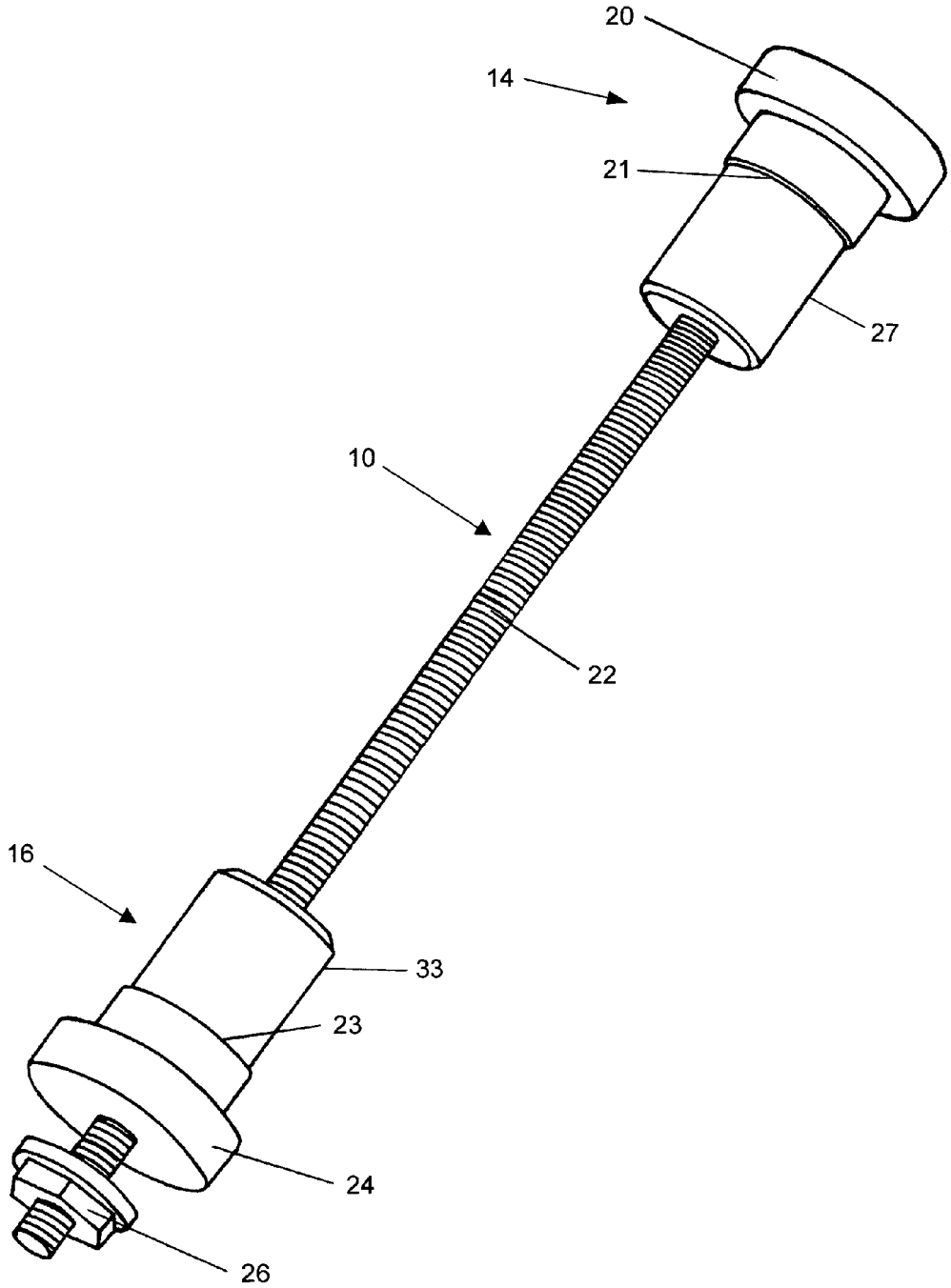
FIG. 1 is a perspective view of a kingpin bushing installation tool according to the present invention.
Figure 2:
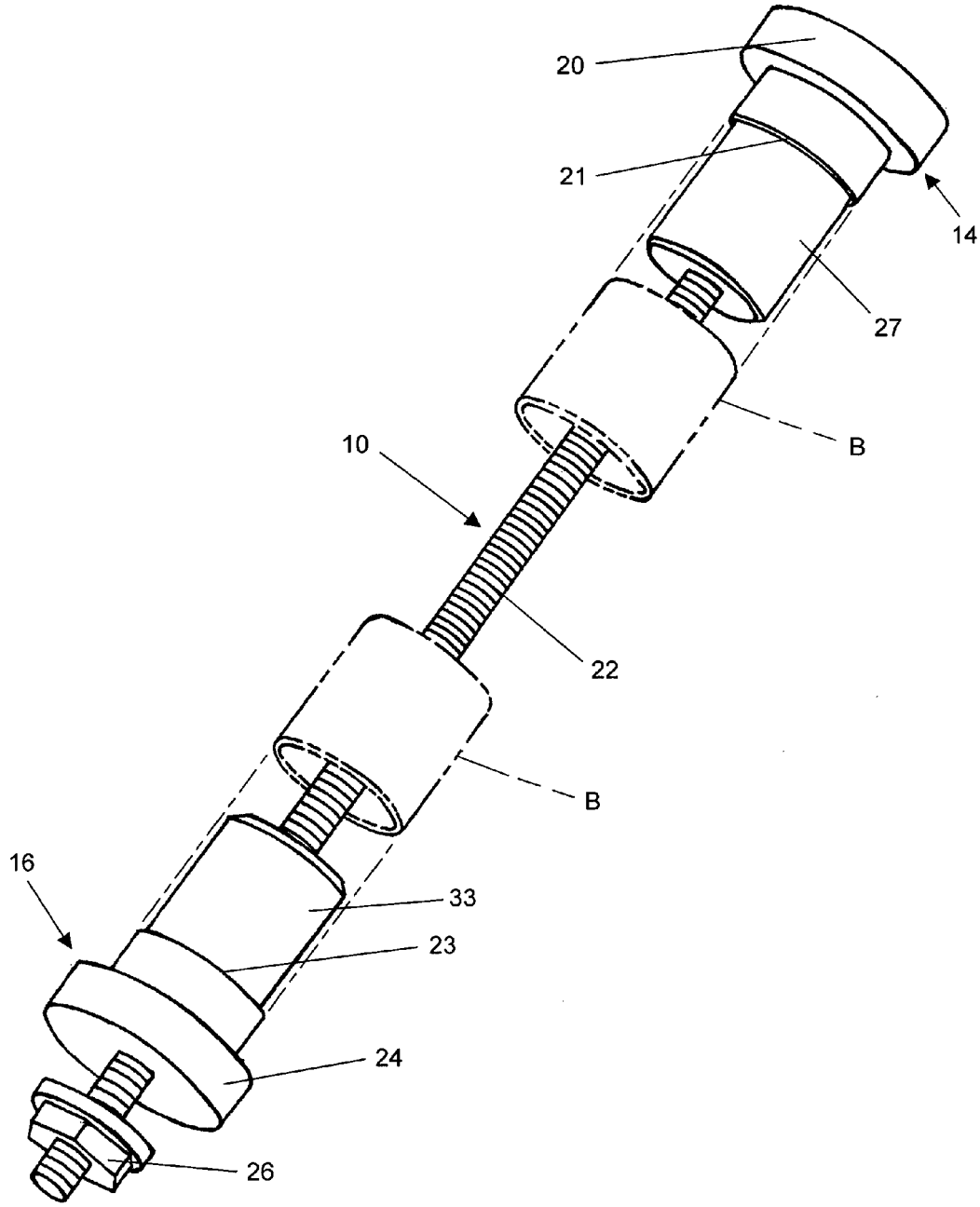
FIG. 2 is a perspective view of the kingpin bushing installation tool according to the present invention, illustrating attachment of a pair of kingpin bushings on respective upper and lower bushing-engaging members.
Figure 3:
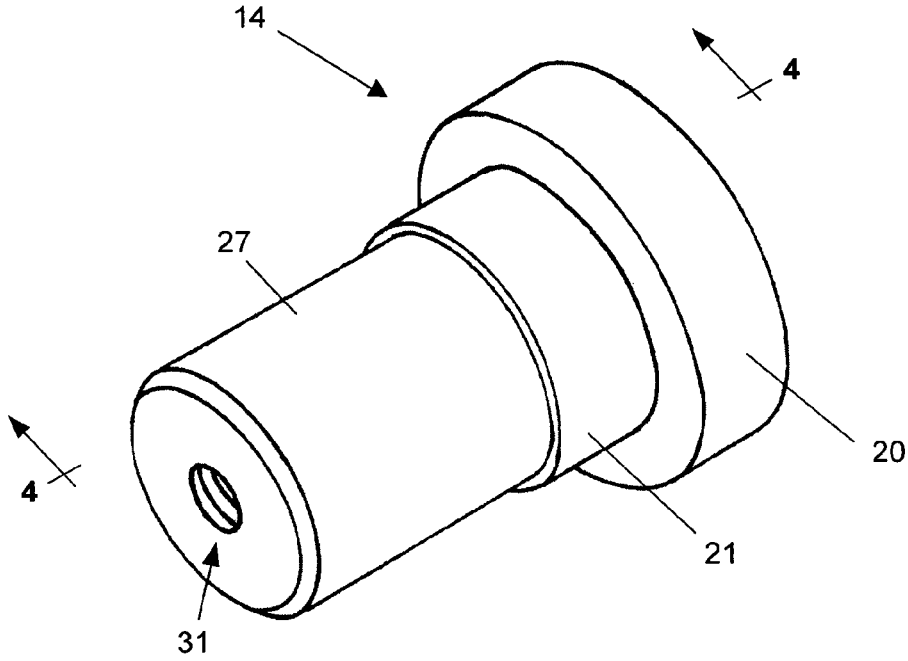
FIG. 3 is a perspective view of the upper bushing-engaging member of the kingpin bushing installation tool of FIG. 1.
Figure 4:
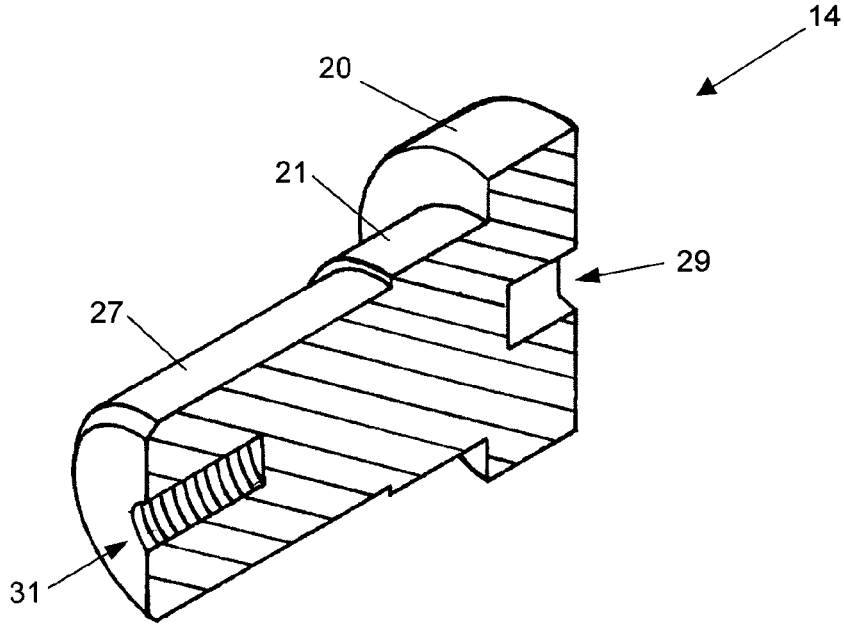
FIG. 4 is a section view taken along lines 4-4 of FIG. 3.
Figure 5:
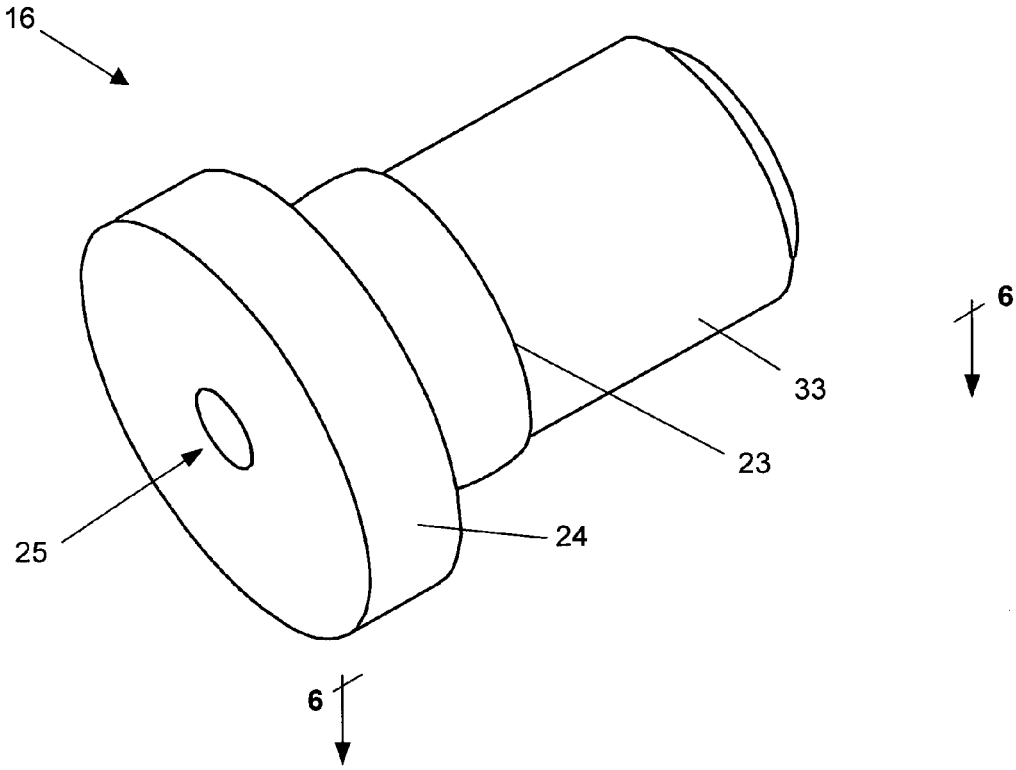
FIG. 5 is a perspective view of the lower bushing-engaging member of the kingpin bushing installation tool of FIG. 1.

Referring now to FIGS. 1 and 2, a first embodiment of the kingpin bushing installation tool 10 is shown. The kingpin bushing installation tool 10 is a dual-headed insertion tool for installing kingpin bushings B within the cylinder cavities C of a steering knuckle S, such as those typically associated with trucks and the like. The kingpin bushing installation tool 10 includes a rod 22 having opposed upper and lower ends, which is preferably threaded, as shown. An upper bushing-engaging member 14 is mounted on the upper end of the rod 22. As shown in FIG. 3, the upper bushing-engaging member 14 includes an upper portion 20, an intermediate portion 21 and a lower portion 27. The intermediate portion 21 has a diameter greater than a diameter of the lower portion 27, and the upper portion 20 has a diameter greater than the diameter of the intermediate portion 21. As best shown in FIG. 4, the upper bushing-engaging member 14 preferably has a threaded recess 31 formed in the lower portion 27 for reception of the upper end of threaded rod 22. A recess 29 may be formed in the upper portion 20 for external mounting. It should be understood that upper bushing-engaging member 14 may be mounted on the upper end of rod 22 through the usage of any suitable attachment.

A lower bushing-engaging member 16 is adjustably and removably mounted on the lower end of the rod 22. The lower bushing-engaging member 16 also includes an upper portion 33, an intermediate portion 23 and a lower portion 24. The intermediate portion 23 thereof has a diameter greater than a diameter of the upper portion 33, and the lower portion 24 thereof has a diameter greater than the diameter of the intermediate portion 23. The lower bushing-engaging member 16 is adjustably and releasably secured to the lower end of the rod 22 by a torque nut 26 or the like.

Figure 6:
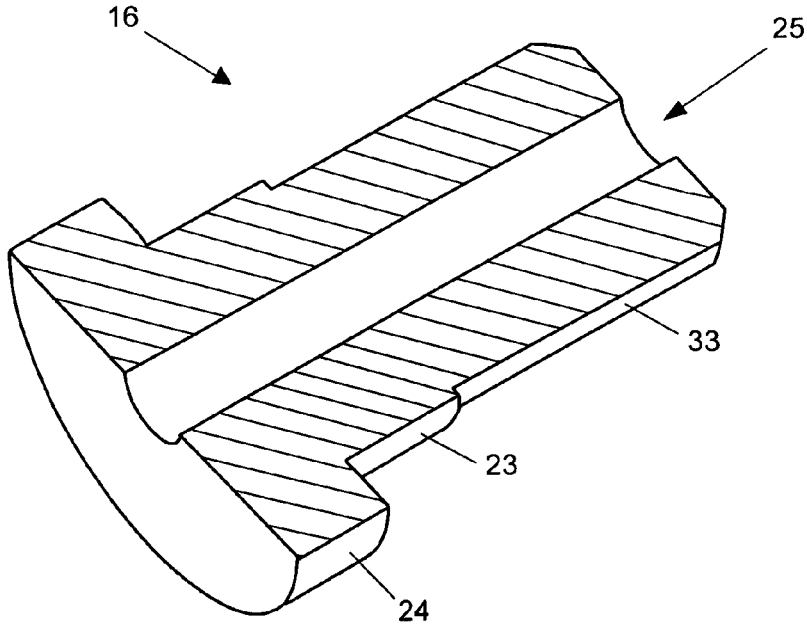
FIG. 6 is a section view taken along lines 6-6 of FIG. 5.

It should be understood that lower bushing-engaging member 16 may be adjustably and removably mounted on the lower end of rod 22 through the usage of any suitable releasable fastener. As best shown in FIG. 6, a through-bore 25 is formed axially through the lower bushing-engaging member 16 for adjustable and removable mounting on the lower end of threaded rod 22. Upper bushing engagement member 14 and lower bushing engagement member 16 are preferably formed from a preheat-treated 4140 steel material, or any other suitable material with high structural strength and low moisture absorption. The rod 22 and torque nut 26 are also preferably formed from steel or any other suitable material.

Figure 7:
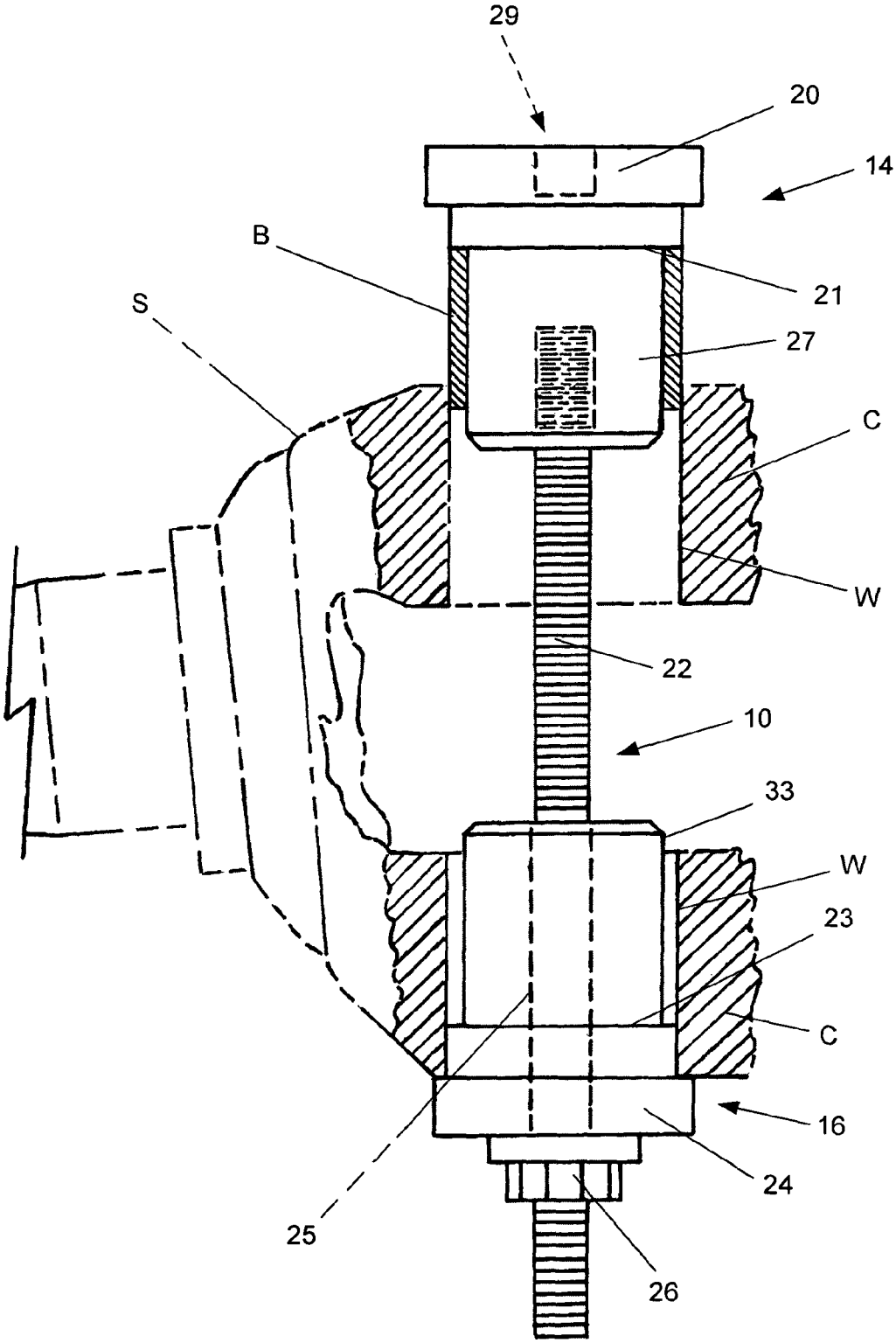
FIG. 7 is an environmental front view of the kingpin bushing installation tool of FIG. 1, with the steering knuckle broken away and partially in section, showing installation of an upper kingpin bushing.

In use, the kingpin bushing installation tool 10 allows for installation of kingpin bushings B into cylinder cavity C of steering knuckle S without damaging walls W. The user initially removes the torque nut 26 from the lower end of threaded rod 22. The lower bushing-engaging member 16 is then removed from the lower end of threaded rod 22. The bushing B is then mounted on the threaded rod 22 by first inserting the lower end of threaded rod 22 through bushing B, then sliding bushing B upwardly until bushing B engages lower portion 27 of upper bushing-engaging member 14. As shown in FIG. 7, the lower portion 27 has a diameter matching the inner diameter of bushing B. The intermediate portion 21 has a slightly larger diameter, thus causing the upper edge of bushing B to contact the lower edge or annularly flanged portion of intermediate portion 21.

The threaded rod 22 is vertically aligned with the central axis of cylinder wall W and is positioned through the upper and lower cavities C, as shown in FIG. 7. Once aligned, with bushing B being at least partially positioned within cavity C and contacting wall W, as shown in FIG. 7, the user re-mounts the lower bushing-engaging member 16 on the lower end of threaded rod 22, and secures the lower bushing-engaging member 16 thereto via torque nut 26. The torque nut 26 is tightened to raise the lower bushing-engaging member 16 until the upper edge of lower portion 24 contacts the lower edge of steering knuckle S. As noted above, upper portion 33 of lower bushing-engaging member 16 has a diameter less than that of intermediate portion 23, and lower portion 24 has a diameter that is greater than that of intermediate portion 23. As shown in FIG. 7, the smaller diameter portions 23, 33 are received within the lower cavity C, with portion 23 having a diameter matching that of the diameter of wall W, and lower portion 24 has a diameter great enough that the upper edge thereof contacts the lower edge of the steering knuckle S.

The user continues to tighten the torque nut 26, causing the threaded shaft 22 and the upper bushing-engaging member 14 to lower with respect to steering knuckle S. This drives the bushing B into the cylinder cavity C. The kingpin bushing B is driven downwardly, frictionally engaging the wall W, until the kingpin bushing B is seated to the proper depth. The bushing B is positioned to the proper depth by the lower edge of upper portion 20 contacting the upper edge of the steering knuckle S, thus stopping movement of the upper bearing engaging member 14 with respect to steering knuckle S.

As noted above, upper bearing engaging member 14 includes an upper portion 20, an intermediate portion 21 and a lower portion 27, with upper portion 20 having a diameter greater than intermediate portion 21, and lower portion 27 having a diameter less than that of intermediate portion 21. As shown in FIG. 7, intermediate portion 21 has a diameter matching the diameter of cavity C, and upper portion 20 has a diameter great enough to rest against the upper, outer edge of steering knuckle S, thus properly positioning bushing B within cylinder C.

Figure 8:
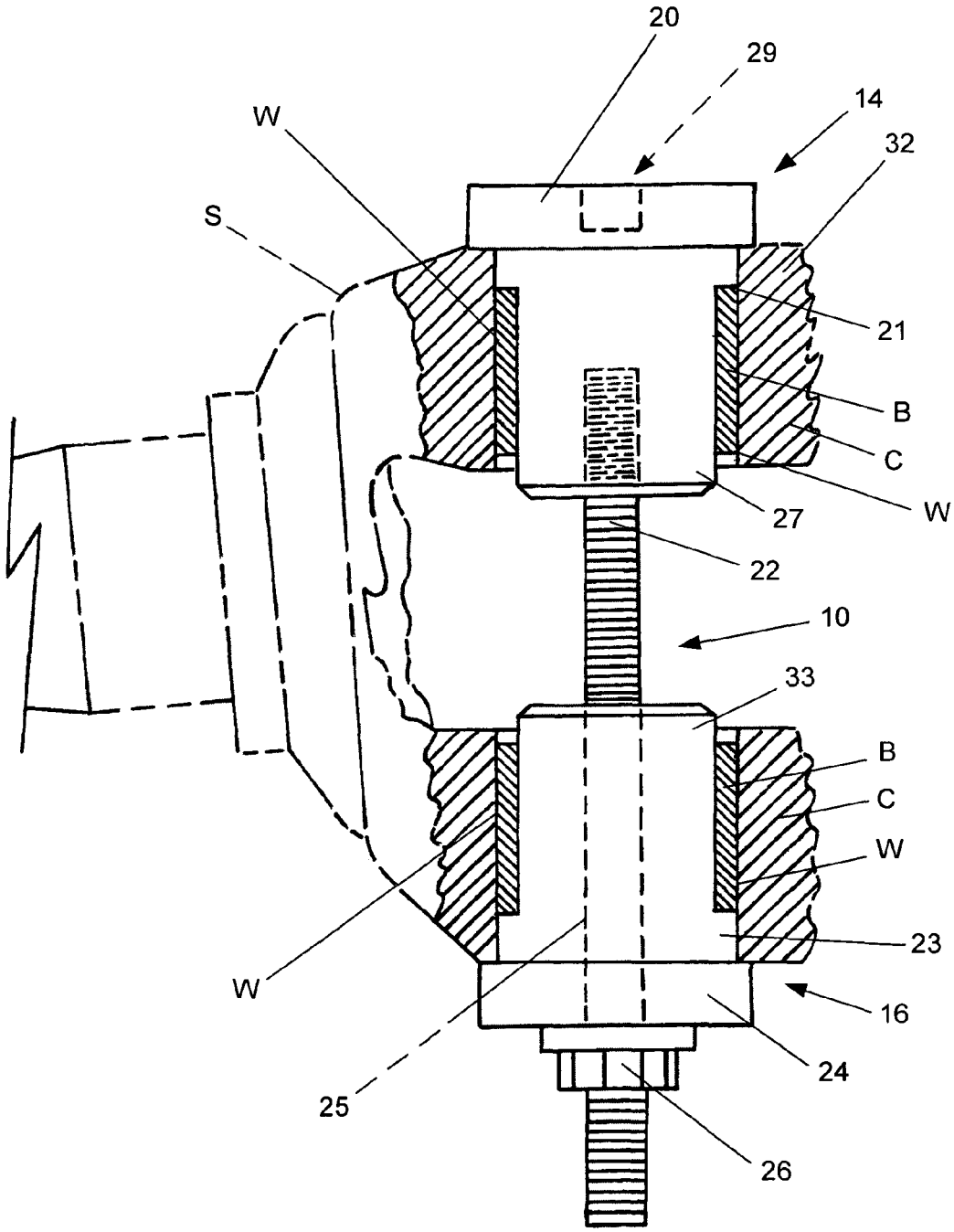
FIG. 8 is an environmental front view of the kingpin bushing installation tool of FIG. 1, with the steering knuckle broken away and partially in section, showing insertion of upper and lower kingpin bushings.

Once bushing B has been inserted, as shown in FIG. 7, the user removes the torque nut 26 again, and then removes the lower bushing-engaging member 16. As shown in FIG. 8, a lower bushing B may then be mounted on upper portion 33 of lower bushing-engaging member 16, and lower bushing-engaging member 16 is re-mounted on the lower end of threaded rod 22. Torque nut 26 is then tightened until bushing B is raised into the proper position within cavity C, with lower portion 24 contacting the lower edge of steering knuckle S outside of cavity C to stop movement of lower bushing-engaging member 16, and properly position lower bushing B. It should be understood that steering knuckle S is shown for exemplary purposes only, and that the dimension and configuration of tool 10 may vary according to the particular cavities C and walls W.

Figure 9:
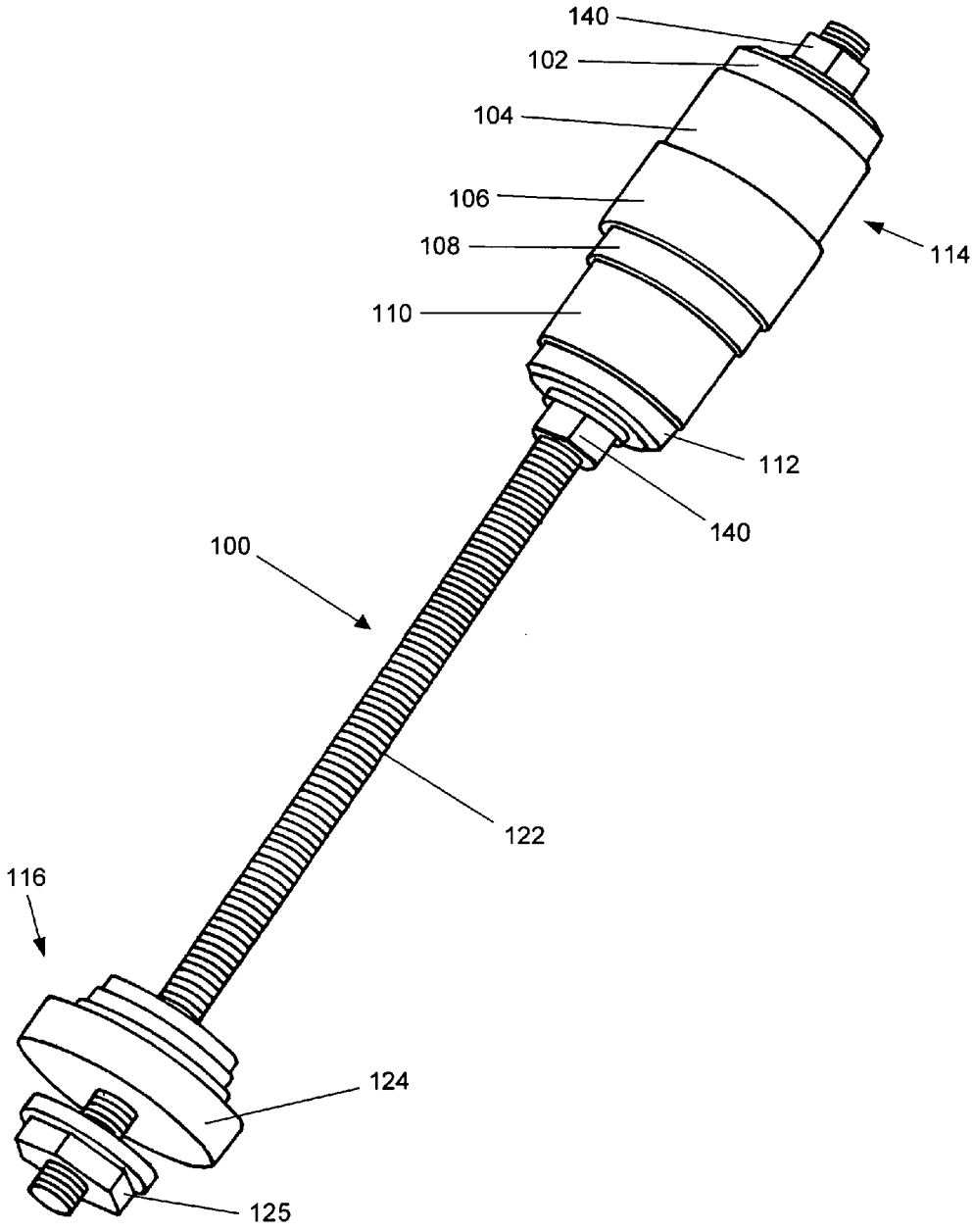
FIG. 9 is a perspective view of an alternative embodiment of a kingpin bushing installation tool according to the present invention.
Figure 10:
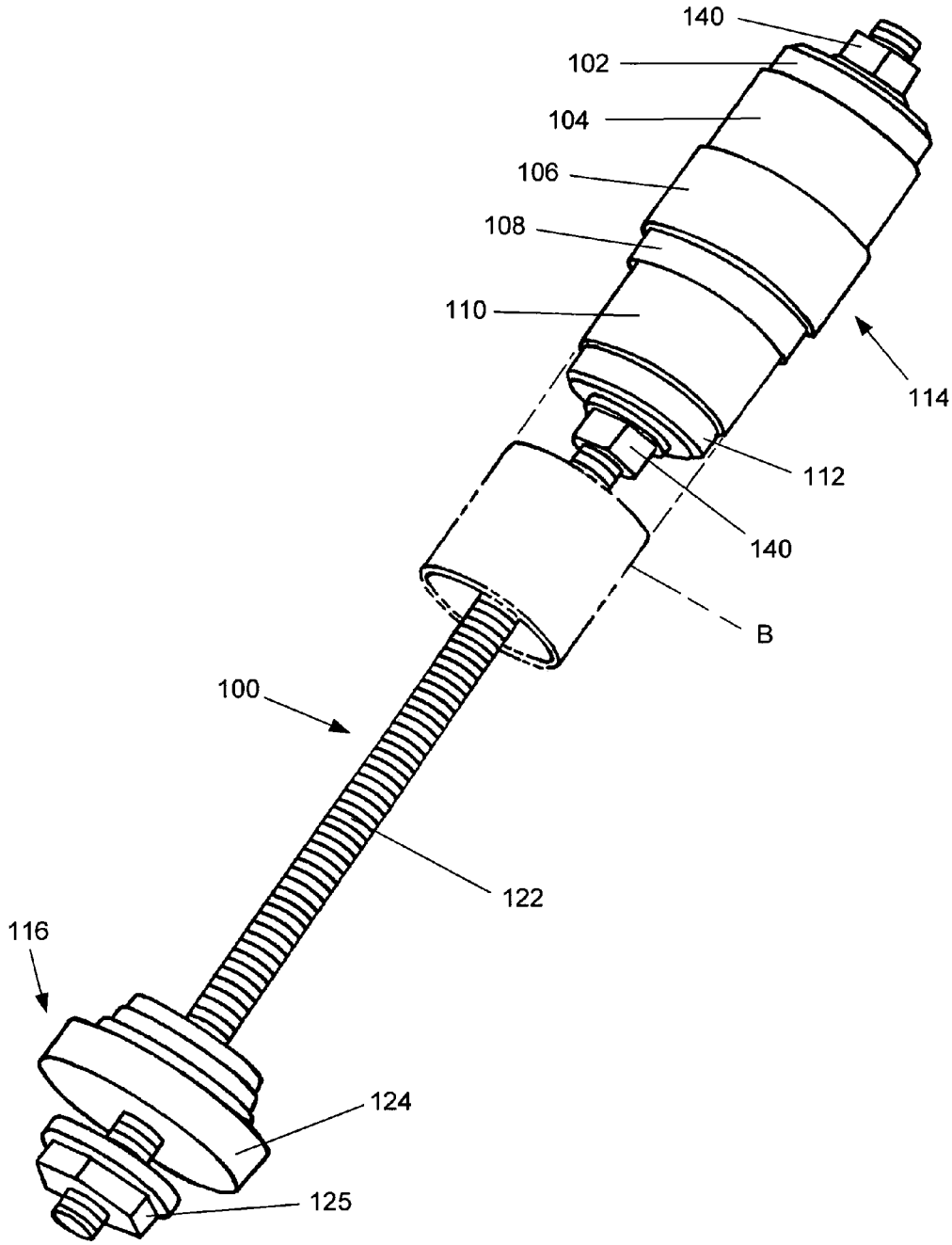
FIG. 10 is a perspective view of the kingpin bushing installation tool of FIG. 9, illustrating attachment of an upper kingpin bushing on the upper bushing-engaging member.
Figure 11:
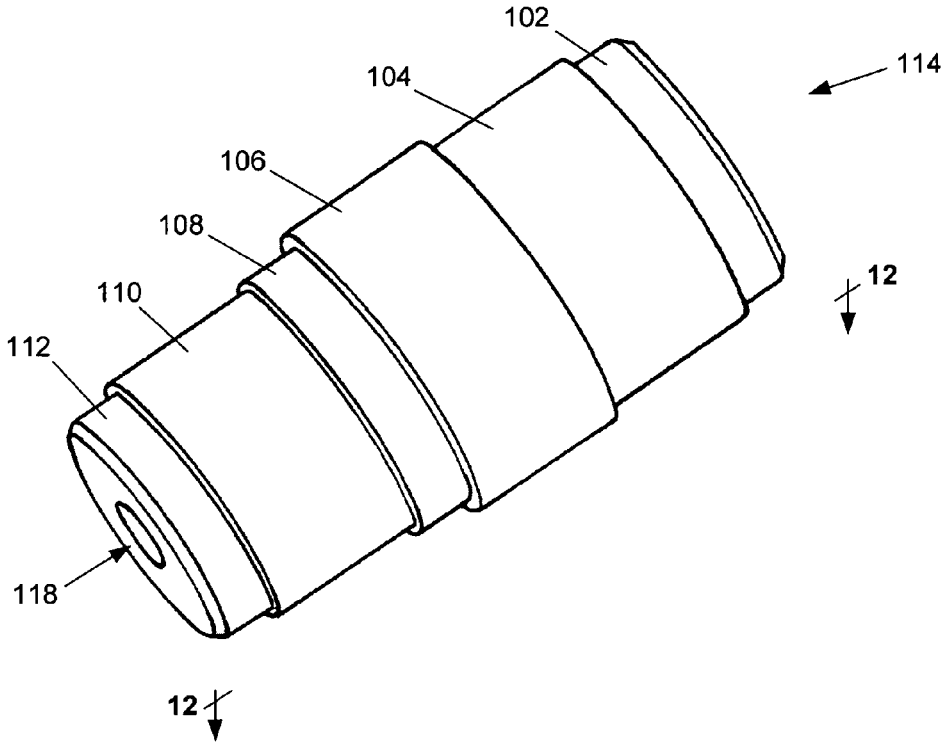
FIG. 11 is a perspective view of the upper bushing-engaging member of the kingpin bushing installation tool of FIG. 9.
Figure 12:
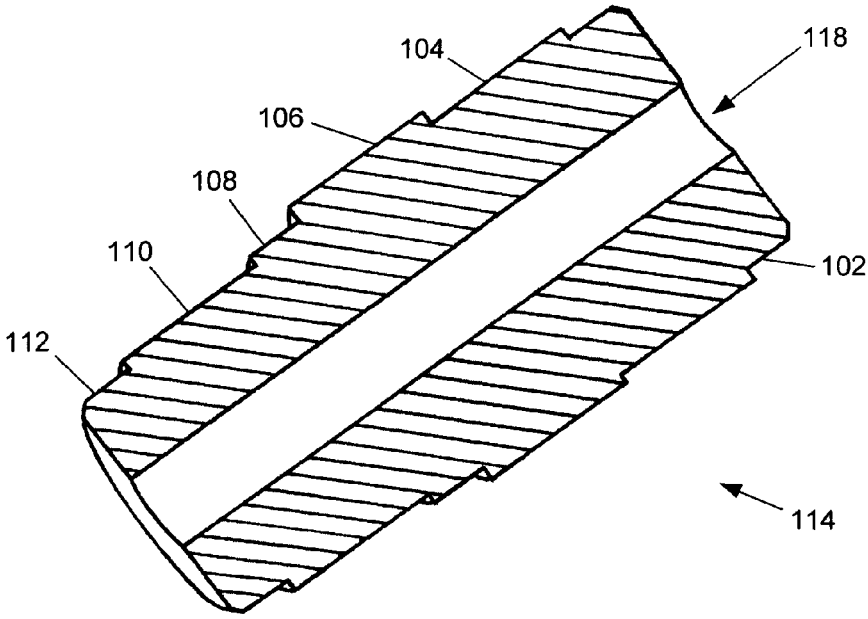
FIG. 12 is a section view taken along lines 12-12 of FIG. 11.

In the alternative embodiment of FIGS. 9-16, with particular reference to FIGS. 9 and 10, the installation tool 100 includes an upper bushing-engaging member 114 mounted on an upper end of threaded rod 122, and a lower bushing-engaging member 116 mounted on the lower end thereof, similar to the embodiment shown in FIGS. 1-8. The upper bushing-engaging member 114, as best shown in FIG. 11, includes an upper portion 102, an intermediate portion and a lower portion 112, with the intermediate portion including a plurality of segments 104, 106, 108, 110. A central one of the plurality of segments 106 has a diameter greater than diameters of the upper and lower portions 102, 112, respectively. The upper bushing-engaging member 114 preferably has an axial through-bore 118 formed therethrough, as best shown in FIG. 12, for reception of the upper end of threaded rod 122.

The plurality of segments of the intermediate portion of the upper bushing-engaging member 114 preferably include the central segment 106, at least one upper segment 104 and at least one lower segment. As shown in FIG. 11, preferably a pair of lower segments 108, 110 are provided. In general, the at least one lower segment has a diameter less than the diameter of the central segment 106 and greater than the diameter of the lower portion 112 of the upper bushing-engaging member 114. As shown in FIG. 11, segment 108 has a diameter less than that of central segment 106, but greater than that of segment 110 which, in turn, has a diameter greater than that of lower segment 112. The at least one upper segment 104 has a diameter less than the diameter of the central segment and greater than the diameter of the upper portion 102. The upper bushing-engaging member is preferably secured to the upper end of the threaded rod 122 by a pair of torque nuts 140, as shown.

Figure 13:
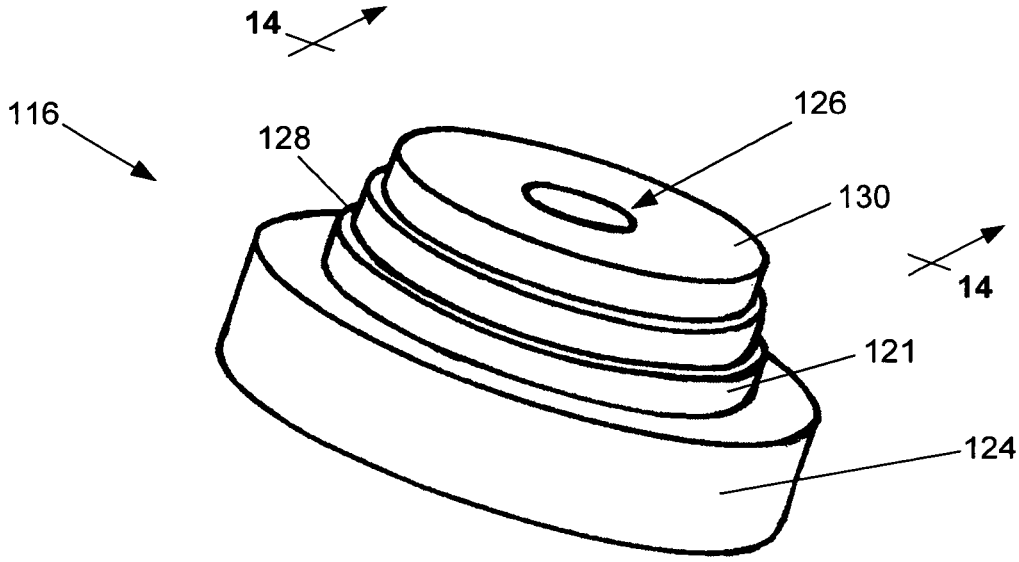
FIG. 13 is a perspective view of the lower bushing-engaging member of the kingpin bushing installation tool of FIG. 9.
Figure 14:
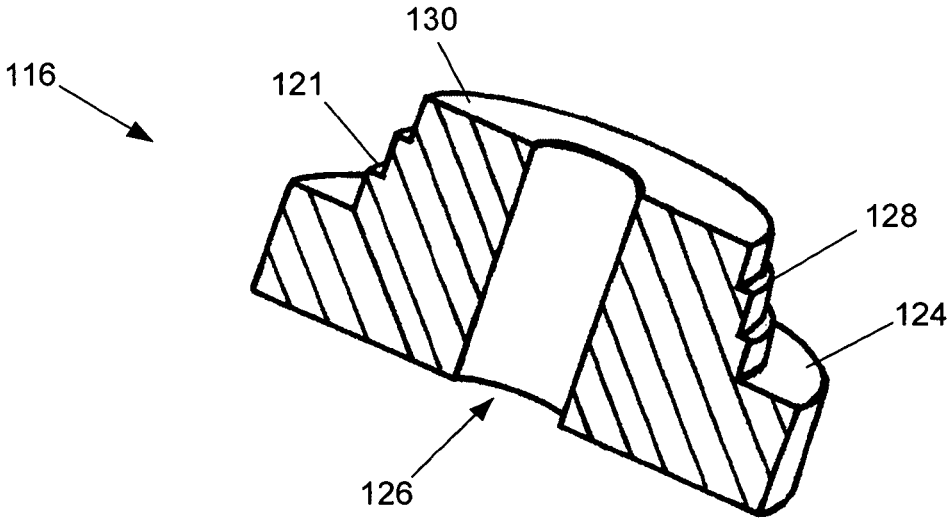
FIG. 14 is a section view taken along lines 14-14 of FIG. 13.

The lower bushing-engaging member 116 is adjustably and removably mounted on the lower end of the rod 122, with the lower bushing-engaging member 116 having an upper portion 130, an intermediate portion and a lower portion 124. In general, the intermediate portion thereof has a diameter greater than a diameter of the upper portion 130, and the lower portion 124 thereof has a diameter greater than the diameter of the intermediate portion. As shown in FIG. 13, the intermediate portion preferably includes a pair of segments 121, 128, with segment 121 having a diameter which is less than that of lower portion 124, but greater than that of segment 128. Upper portion 130 has a diameter less than that of segment 128. An axial through-bore 126, as best shown in FIG. 14, is formed through the lower bushing-engaging member 116 for reception of the lower end of threaded rod 122. Lower bushing-engaging member 116 is adjustably and removably secured to the lower end of rod 122 by a torque nut 125 or the like.

Figure 15:
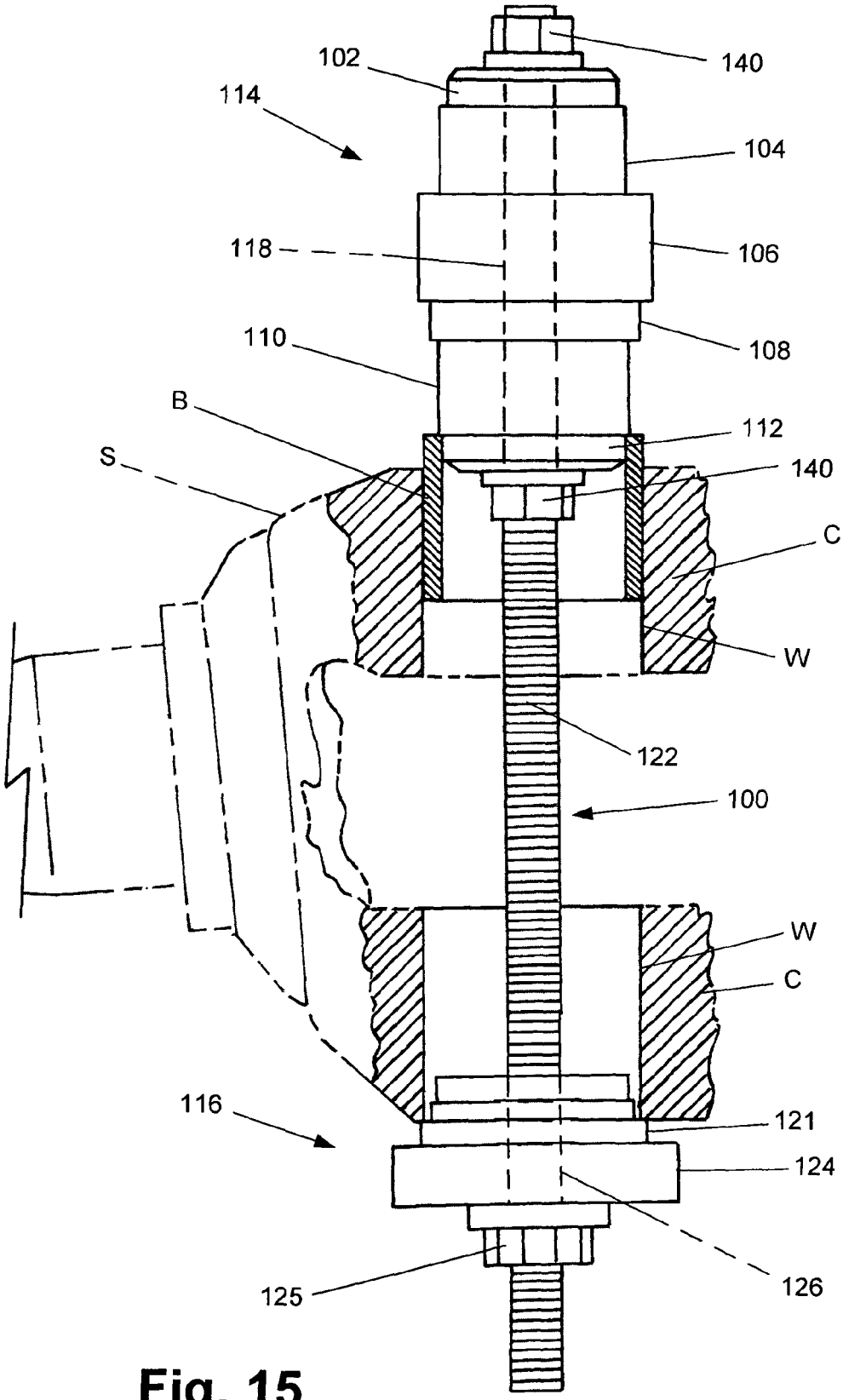
FIG. 15 is an environmental front view of the kingpin bushing installation tool of FIG. 9, with the steering knuckle broken away and partially in section, showing installation of an upper kingpin bushing.

In use, the kingpin bushing installation tool 100 allows for installation of kingpin bushings B into cylinder cavity C of steering knuckle S without damaging walls W. The user initially removes the lower torque nut 125 from the lower end of threaded rod 122. The lower bushing-engaging member 116 is then removed from the lower end of threaded rod 122. The bushing B is then mounted on the threaded rod 122 by first inserting the lower end of threaded rod 122 through bushing B, then sliding bushing B upwardly until bushing B engages lower segment 112 of upper bushing-engaging member 114. As shown in FIG. 15, the lower segment 112 has a diameter matching the inner diameter of bushing B. The first intermediate segment 110 has a slightly larger diameter, thus causing the upper edge of bushing B to contact the lower edge or annularly flanged portion of first intermediate segment 110.

The threaded rod 122 is vertically aligned with the central axis of cylinder wall W and is positioned through the upper and lower cavities C, as shown in FIG. 15. Once aligned, with bushing B being at least partially positioned within cavity C and contacting wall W, as shown in FIG. 15, the user remounts the lower bushing-engaging member 116 on the lower end of threaded rod 122, and secures the lower bushing-engaging member 116 thereto via lower torque nut 125. The lower torque nut 125 is tightened to raise the lower bushing-engaging member 116 until one of the segments contacts the lower edge of steering knuckle S. As noted above, a plurality of segments 124, 121, 128, 130 are provided, each having a differing diameter. This allows the tool 100 to be used with a variety of steering knuckles S of varying size. As shown in the example of FIG. 15, the smaller diameter segments are received within the lower cavity C, and segment 121 has a diameter great enough to contact the lower edge of the steering knuckle S.

The user continues to tighten the lower torque nut 125, causing the threaded shaft 122 and the upper bushing-engaging member 114 to lower with respect to steering knuckle S. This drives the bushing B into the cylinder cavity C. The kingpin bushing B is driven downwardly, frictionally engaging the wall W, until the kingpin bushing B is seated to the proper depth. The bushing B is positioned to the proper depth by the lower edge of intermediate segment 106 contacting the upper edge of the steering knuckle, thus stopping movement of the upper bearing engaging member 114 with respect to steering knuckle S.

As noted above, upper bearing engaging member 1114 includes a lower segment 112, an upper segment 102, and a plurality of intermediate segments 104, 106, 108 and 110, with segment 110 having a diameter greater than segment 112, segment 108 having a diameter greater than segment 110, segment 106 having the largest diameter, and segment 104 having a diameter greater than upper segment 102. This allows for the usage of tool 100 with a wide variety of steering knuckles S having cavities C of varying diameters. In the example of FIG. 15, segment 110 has a diameter greater than the internal diameter of bushing B. The depth of bushing B is controlled manually by turning torque nut 125, thus properly positioning bushing B within cylinder C.

Figure 16:
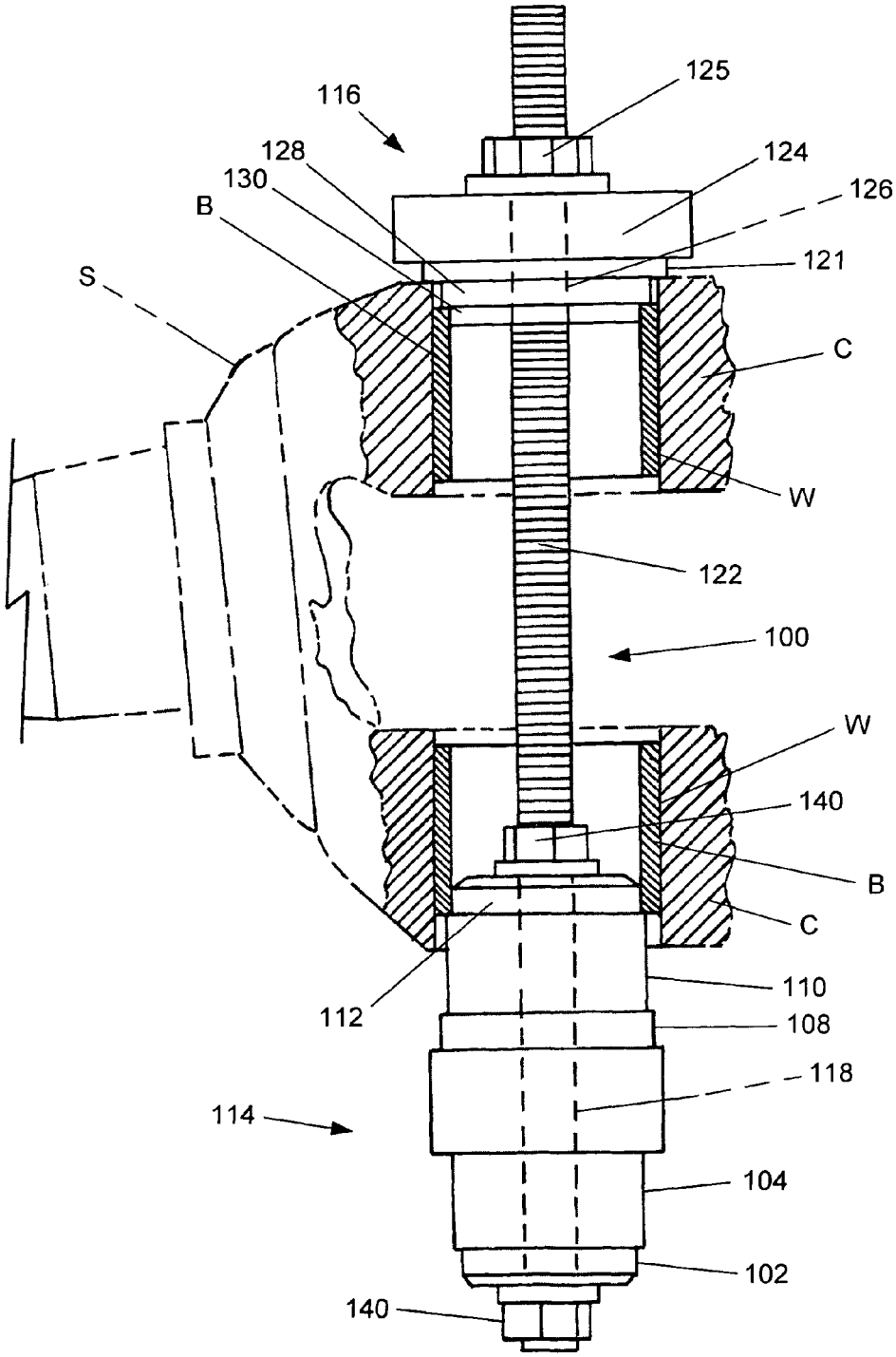
FIG. 16 is an environmental front view of the kingpin bushing installation tool of FIG. 9, the steering knuckle being broken away and partially in section, showing installation of upper and lower kingpin bushings.

Once bushing B has been inserted, as shown in FIG. 15, the user removes the lower torque nut 125 again, and then removes the lower bushing-engaging member 116. The threaded rod 122 and the upper bushing-engaging member 114 are then removed from the cylinder cavity C. As shown in FIG. 16, in order to install a bottom kingpin bushing B into the lower cylinder cavity C once the upper bushing B has been inserted, the above process is reversed, with the orientation of the upper and lower bushing-engaging members. It should be understood that vertical steering knuckle S is shown for exemplary purposes only, and that the dimension and configuration of tool 100 may vary according to the particular cavities C and walls W.

It is to be understood that the present invention is not limited to the embodiments described above, but encompasses any and all embodiments within the scope of the following claims.

I claim:

1. A dual-headed kingpin bushing installation tool, comprising:

an elongated rod having opposed upper and lower ends;

an upper bushing-engaging member mounted on the upper end of the rod, the upper bushing-engaging member consisting essentially of an upper portion, an intermediate portion and a lower portion, the intermediate portion having a diameter greater than the lower portion, the upper portion having a diameter greater than the diameter of the intermediate portion;

a lower bushing-engaging member adjustably and removably mounted on the lower end of the rod, the lower bushing-engaging member consisting essentially of an upper portion, an intermediate portion and a lower portion, the intermediate portion thereof having a diameter greater than the upper portion, the lower portion thereof having a diameter greater than the diameter of the intermediate portion; and means for adjustably securing the lower bushing-engaging member to the lower end of the rod.

2. The kingpin bushing installation tool as recited in claim 1, wherein said rod is threaded.

3. The kingpin bushing installation tool as recited in claim 2, wherein said means for adjustably securing said lower bushing-engaging member to the lower end of said rod comprises a torque nut.

4. The kingpin bushing installation tool as recited in claim 3, wherein an internally threaded blind bore is axially formed in the lower portion of said upper bushing-engaging member.

5. The kingpin bushing installation tool as recited in claim 4, wherein a through-bore is axially formed through the lower bushing-engaging member.

6. A dual-headed kingpin bushing installation tool, comprising:

an elongated rod having opposed upper and lower ends;

an upper bushing-engaging member mounted on the upper end of the rod, the upper bushing-engaging member consisting essentially of an upper portion, an intermediate portion and a lower portion, the intermediate portion defining a plurality of segments including a central segment having a diameter greater than the upper and lower portions;

a lower bushing-engaging member adjustably and removably mounted on the lower end of the rod, the lower bushing-engaging member consisting essentially of an upper portion, an intermediate portion and a lower portion, the intermediate portion thereof having a diameter greater than the upper portion, the lower portion thereof having a diameter greater than the diameter of the intermediate portion; and means for adjustably securing the lower bushing-engaging member to the lower end of the rod.

7. The kingpin bushing installation tool as recited in claim 6, wherein said rod is threaded.

8. The kingpin bushing installation tool as recited in claim 7, wherein said means for adjustably securing said lower bushing-engaging member to the lower end of said rod comprises a torque nut.

9. The kingpin bushing installation tool as recited in claim 8, wherein a through-bore is axially formed in the lower portion of said upper bushing-engaging member.

10. The kingpin bushing installation tool as recited in claim 9, wherein a through-bore is axially formed through the lower bushing-engaging member.

11. The kingpin bushing installation tool as recited in claim 6, wherein the plurality of segments of the intermediate portion of said upper bushing-engaging member comprise the central segment, at least one upper segment and at least one lower segment.

12. The kingpin bushing installation tool as recited in claim 11, wherein the at least one lower segment has a diameter less than the diameter of the central segment and greater than the diameter of the lower portion of said upper bushing-engaging member.

13. The kingpin bushing installation tool as recited in claim 12, wherein the at least one upper segment has a diameter less than the diameter of the central segment and greater than the diameter of the upper portion of said upper bushing-engaging member.

14. The kingpin bushing installation tool as recited in claim 13, wherein the intermediate portion of said lower bushing-engaging member comprises an upper segment and a lower segment, the upper segment having a diameter greater than the diameter of the upper portion, the lower segment having a diameter greater than the diameter of the upper segment and less than the diameter of the lower portion.

15. The kingpin bushing installation tool as recited in claim 6, further comprising means for securing the upper bushing-engaging member to the upper end of said rod.

16. The kingpin bushing installation tool as recited in claim 15, wherein the rod is threaded.

17. The kingpin bushing installation tool as recited in claim 16, wherein said means for securing the upper bushing-engaging member to the upper end of said rod comprise a pair of torque nuts.

* * * * *